United States Patent [19]

Kishi et al.

[11] 4,021,275

[45] May 3, 1977

[54] GAS-GENERATING AGENT FOR AIR BAG

[75] Inventors: Kazuo Kishi; Kazuo Naganuma, both of Himeji, Japan

[73] Assignee: Daicel, Ltd., Osaka, Japan

[22] Filed: Oct. 29, 1975

[21] Appl. No.: 626,725

[30] Foreign Application Priority Data

| | | |
|---|---|---|
| Apr. 23, 1975 | Japan | 50-49413 |
| Apr. 23, 1975 | Japan | 50-49414 |
| Apr. 30, 1974 | Japan | 49-52194 |

[52] U.S. Cl. ..... 149/35; 23/281; 252/188.3 R; 252/350; 264/3 C; 264/3 E; 280/741

[51] Int. Cl.[2] ..... C06B 35/00

[58] Field of Search ..... 149/35; 252/188.3 R, 252/350; 23/281; 280/150 AB; 252/741; 264/3 C, 3 E

[56] References Cited

UNITED STATES PATENTS

| | | | |
|---|---|---|---|
| 2,981,616 | 4/1961 | Boyer | 149/35 |
| 3,785,674 | 1/1974 | Poole et al. | 23/281 |
| 3,814,694 | 6/1974 | Klager et al. | 252/188.3 R |
| 3,862,866 | 1/1975 | Timmerman | 252/188.3 R |
| 3,912,561 | 10/1975 | Doin et al. | 149/35 |
| 3,920,575 | 11/1975 | Shiki et al. | 149/35 |
| 3,936,330 | 2/1976 | Dergazarian | 149/35 |

FOREIGN PATENTS OR APPLICATIONS

| | | | |
|---|---|---|---|
| 1,391,310 | 4/1975 | United Kingdom | 149/35 |

*Primary Examiner*—Benjamin R. Padgett
*Assistant Examiner*—T. S. Gron
*Attorney, Agent, or Firm*—Woodhams, Blanchard and Flynn

[57] ABSTRACT

A gas-generating agent for inflating air bags comprises finely divided particles of a co-precipitation compound made by the following steps: (1) uniformly mixing in water to form an aqueous solution a composition comprising (a) one or a mixture of two or more alkali metal azides and/or alkaline earth metal azides and (b) an aqueous solution of a composition comprising one or a mixture of two or more nitrates or perchlorates of alkali metals or alkaline earth metals; or mixing (a) and (b) plus (c) finely divided particles of silicon dioxide; or mixing (a), (b) and (c) plus (d) fine glass powder; (2) mixing the resulting solution or suspension with a water-soluble organic solvent; and (3) separating and drying the co-precipitation compound thus obtained. The gas-generating agent will not produce toxic compounds such as sodium metal and sodium peroxide which might injure the car driver and passengers. Further, when low softening glass is added, the maximum temperature of combustion will be lowered.

7 Claims, 4 Drawing Figures

GAS-GENERATING AGENT FOR AIR BAG

BACKGROUND OF THE INVENTION

1. Field of the Invention

This invention relates to a gas-generating composition useful for inflating air bags in motor vehicles, when a collison occurs, to cushion vehicle occupants against forcible contact with hard surfaces of the vehicle body.

2. Description of the Prior Art

Recently automobile accidents have been greatly increasing year-by-year, so that the development of inflatable air bags for protecting the human body is strongly desired in order to protect the occupants of automobiles from serious injury in the event of a collision. Some types of such bags are in practical use. Available gas-generating sources for such air bags include liquefied gases, solid gas-generating agents, and combinations of them. However, the use of solid gas-generating agents is preferred because such agents can be contained in a small device.

The gas for expanding the air bag must be completely nontoxic, because it might possibly contact directly with the automobile occupants if it should leak from the bag. Therefore, mixtures essentially composed of alkali metal and alkaline earth metal salts of hydrazoic acid (hereinafter designated as metal azides) are particularly preferred, as described in U.S. Pat. No. 2,981,616, because they decompose to generate clean gases. However, many residues of alkali metals, alkaline earth metals, and their oxides (hereinafter designated as residues), which are produced simultaneously with the inflating gas, are chemically active and toxic. Some of them react vigorously with moisture in the air to evolve hydrogen, thus increasing the danger of fire. Moreover, if the residues are inhaled by humans along with the gas leaked from the air bag, or if they should contact human skin, they would seriously injure the human body.

Thus, in developing gas-generating agents mainly consisting of these metal azides, there must also be considered the use of a chemically detoxicating composition or a filtering system to readily capture these residues.

The gas-generating agents mainly composed of a metal azide known in the prior art are mixtures of (A) an alkali metal azide and/or an alkaline earth metal azide and (B) an oxidizing agent (hereinafter designated as oxidant) of (1) one or more nitrates and perchlorates of alkali metals and alkaline earth metals and (2) one or more of metal oxides.

The theoretical gas-generating mechanisms of an agent comprising a metal azide and an oxidant are as follows:

$$10\ NaN_3 + 2\ KNO_3 \rightarrow 5\ Na_2O + K_2O + 16\ N_2 \quad (1)$$

$$8\ NaN_3 + NC10_4 \rightarrow 4\ Na_2O + KCl + 12\ N_2 \quad (2)$$

However, when the theoretical amounts of sodium azide and potassium nitrate in reaction (1) are merely mechanically mixed or the theoretical amounts of sodium azide and potassium perchlorate in reaction (2) are merely mechanically mixed, and further when such compositions are molded into shapes suitable for combustion, such moldings always produced sodium metal and sodium peroxide during combustion.

This is ascribed to the belief that the gas-generating agent composed of the metal azide and oxidant in the prior art actually reacts as follows:

$$10\ NaN_3 + 2\ KNO_3 \rightarrow a\ Na + b\ Na_2O + c\ Na_2O_2 + 16\ N_2 + K_2O \quad (3)$$

wherein $a + 2(b+c) = 10$, $$8\ NaN_3 + KC10_4 \rightarrow x\ Na_2O_2 + y\ Na_2O + z\ Na + KCl + 12\ N_2 \quad (4)$$

wherein $0<x \leqq 2$, $0 \leqq y<4$, $0<z \leqq 4$, and $x + y + z = 8$.

The sodium metal and sodium peroxide produced by the foregoing reactions (3) and (4) are very fine toxic powders and they disperse into the generated gas. Therefore, in using the prior art gas-generating agent of the metal azide and oxidant, the air bag system must be equipped with a device for capturing the residues.

Consequently, there are already known many methods for separating the residues from the generated gas, including the use of a mechanical filtering system provided in the gas-flow path and the use of a filter layer which is provided for reacting with and fixing the residues. The mechanical filtering system includes baffle plates provided in the gas-flow path, thereby to change the direction of gas-flow and to separate the gas and residues as described in U.S. Pat. No. 2,756,375; and the filter layer combined with wire nets of different meshes as described in Japanese Patent (unexamined) No. 1974-13,838.

A chemical filtering system includes a layer packed with boric anhydride or silicone resin coated on a carrier such as alumina, thereby to capture the residues dispersed in the gas by reacting the residues with the boric anhydride or silicone resin in the layer while the gas passes through the layer as described in U.S. Pat. application Ser. No. 152,897 U.S. Pat. No. 3,797,854. However, the residues produced during combustion are very fine and they are transferred along with a lot of the generated gas. Therefore, the foregoing filtering systems cannot filter the solid residues sufficiently.

Contrary to these methods, there is also known a method for changing the residues produced from the gas-generating agent of metal azide and oxidant into a nontoxic form by using silica and silicate (hereinafter designated as silicon dioxide) as described in West German Patent (unexamined) No. 22 36 175.7. The silicon dioxide can form a low melting glass with the residues, as follows:

$$5\ Na_2O + K_2O + 6\ SiO_2 \rightarrow 5\ Na_2O.K_2O.6\ SiO_2 \quad (5)$$

Further, there have been known methods using metal oxides such as lead oxide and ferric oxide along with the silicon dioxide to promote the reaction (5). Such methods can make the gas generator structurally simpler and functionally more effective than the method employing a filtering system as discussed above.

In the method using silicon dioxide, the silicon dioxide must be mixed with the metal azide and the oxidant uniformly in an amount sufficient to react the silicon dioxide stoichiometrically with the residues as shown in reaction (5). By the conventional methods of mechanical mixing, however, it is difficult to mix enough silicon dioxide sufficiently uniformly with the metal azide and oxidant. Thus, it is difficult to react the silicon dioxide with the residues and thereby to form a low melting glass. Further, the resulting gas-generating agent is inferior in combustibility because the components are mixed nonuniformly as described earlier.

SUMMARY OF THE INVENTION

The inventors have intensively studied different types of gas-generating agents for air bags and have discovered new agents, as follows: (A) a gas-generating agent consisting essentially of fine powders of a co-precipitation compound of azide and oxidant; (B) a gas-generating agent comsisting essentially of fine powders of said co-precipitation compound of azide and oxidant, and silicon dioxide; (C) a gas-generating agent consisting essentially of fine powders of said co-precipitation compound of azide and oxidant, silicon dioxide and glass.

The co-precipitation compound of the agent (A) is obtained by the following steps: (1) an aqeuous solution of (a) one or more alkali metal azides and alkaline earth metal azides and an aqueous solution of (b) one or more of alkali metal and alkaline earth metal nitrates and perchlorates are together (after mixing) poured into a water-soluble organic solvent, or a single solution obtained by mixing (a) and (b) in water is poured into said water-soluble organic solvent, and (2) the resulting co-precipitation compound is filtered off and dried. The compound is then molded into a shape suitable for combustion. The water-soluble solvent includes methanol, ethanol, acetone, iso-propanol and the like.

The co-precipitation compound comprises the azide and the oxidant which are mixed uniformly enough to react homogeneously, so that the co-precipitation compound possesses excellent combustibility. Also, if the components are contained in the theoretical amounts in the co-precipitation compound, they react as shown in reaction schemes (1) and (5) and they will not produce toxic alkali metals, alkaline earth metals, and peroxides of alkali metals and alkaline earth metals such as shown in reaction formula (3). Even if the components are not present in the theoretical ratio, in the co-precipitation compound the compound produces much less of the foregoing toxic by-products than the prior art compositions made by the conventional methods. Therefore, the use of the agent makes it possible to greatly simplify the protective systems, such as the filtering system.

The agents (B) and (C) can be prepared by the same method as that used for making the agent, (A), except that silicon dioxide (for agent B), or silicon dioxide and glass (for agent C), are mixed with the aqueous solution of metal azide and oxidant and then the mixture is poured into the water-soluble organic solvent. In more detail, the agents can be made by the following steps:

(1) a mixture of the prescribed amounts of metal azide and oxidant is dissolved in a sufficient amount of water, (2) silicon dioxide, or silicon dioxide and glass powder, are added to the resulting solution and mixed uniformly therein, (3) the dispersion thus obtained is poured with stirring into a vessel provided with a stirrer wherein a water-soluble organic solvent, such as methanol, ethanol, and acetone, has been previously charged, (4) the resulting uniform composition consisting essentially of the co-precipitation compound of metal azide and oxidant, and silicon dioxide, or silicon dioxide and the glass, produced immediately is filtered off and dried, and, if required, (5) the compound is press-molded into a shape suitable for combustion.

On combustion of the composition of the invention, the azide and the oxidant in the agents react homogeneously and rapidly to generate nitrogen gas because the compounds are uniformly mixed, and the residues are immediately changed into a low melting nontoxic material by the reaction of the silicon dioxide and/or glass with the residues.

The mixing ratio of metal azide to the oxidant in the co-precipitation compound is in the range of 95 : 5 to 50 : 50, parts by weight. The mixing ratio of the co-precipitation compound to silicon dioxide is in the range of 97 : 3 to 55 : 45. Further, the added amount of glass in Agent C is in the range of 3 to 50 percent by weight, based on the total weight of the resultant composition.

The silicon dioxide used in this invention includes a flocculate of fine spherical powders of silicon dioxide or colloidal silica, wherein the individual particles comprising the flocculate and the individual particles of collidal silica have a particle size in the range of 1 to 100 millimicrons. The silicon dioxide powder is obtained by hydrolyzing silicon tetrachloride in an oxyhydrogen flame. The flocculate of fine spherical powders of silicon dioxide is from 2 to 150 microns in overall flocculate size and from 50 to 450 $m^2/g$ in surface area. The colloidal silica is obtained by neutralizing an aqueous solution of sodium silicate with an acid. The colloidal silica is 1 to 100 millimicrons in particle size and from 22 to 120 $m^2/g$ in surface area.

By adding the silicon dioxide, the residues of metal and other substances formed during combustion can be transformed into a glass which can be captured very easily as described earlier. However, the glass is originally of fine particle size. If the glass is changed into a coarser mass, the resulting substance can be captured more easily and completely. Thus, we have discovered that this object can be attained by adding powders of a low softening glass to the composition in Agent C. The glass powder has an appreciably larger particle size than the silicon dioxide particles and the co-precipitation compound.

The glass used in this invention is a composition consisting essentially of 5 to 75% by weight of $SiO_2$, 0 to 50% by weight of CaO, 1 to 40% by weight of $Al_2O_3$, 0 to 25% by weight of $B_2O_3$, 0 to 20% by weight of $K_2O$ and $Na_2O$, 0 to 15% by weight of MgO, and 0 to 60% by weight of PbO. Its preferable particle size is 5 to 300 microns.

Figure 1:
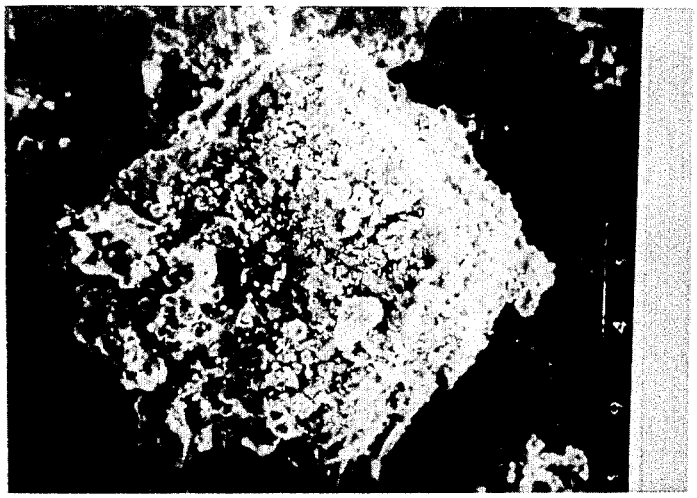
FIG. 1 is an electron microscope photograph of the gas-generating agent C according to the invention (magnification : 1000*x*).

The electron microscope photograph of the co-precipitation compound (FIG. 1) deposited on glass particles shows that the surface of the large-sized glass particles is covered with fine crystals of the co-precipitation compound. From this observation and general knowledge of co-precipitation phenomena, it can be considered that the agents of this invention consist essentially of, for agent A, the co-precipitation compound, or for agent B, silicon dioxide covered and/or mixed with the fine crystals of metal azide and oxidant, or for agent C, silicon dioxide covered with said crystals and mixed with glass powder, and /or glass powder covered with silicon dioxide which is in turn covered with said crystals, or some other type of complex mixture or aggregate of those particles.

Figure 2:
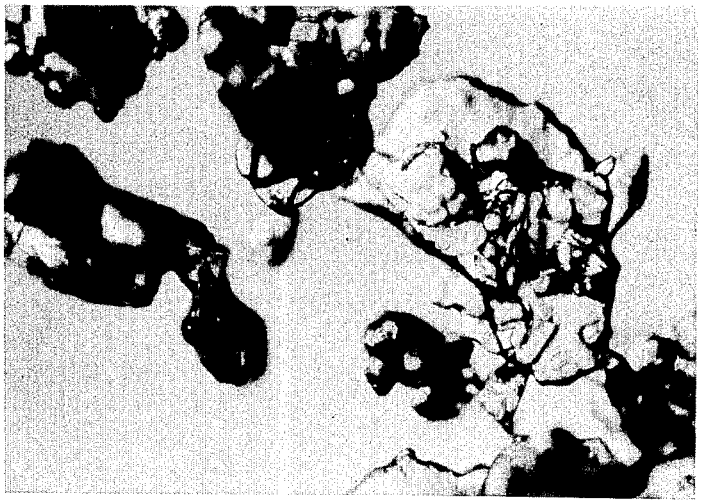
FIG. 2 is a microscope photograph of particles of sodium azide made by the conventional method (magnification : 200x).
Figure 3:
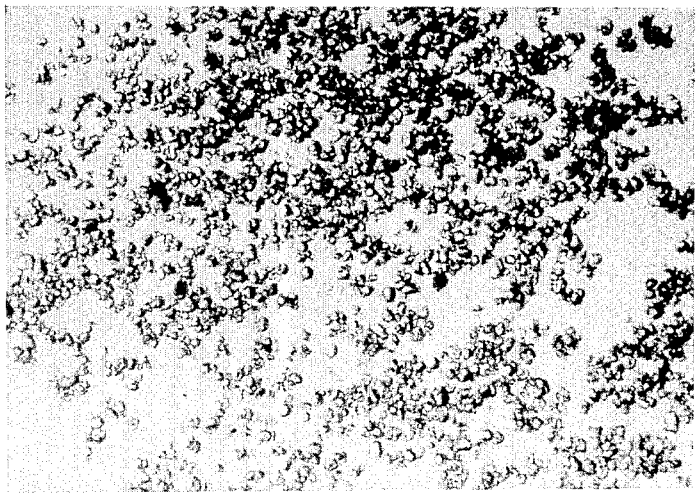
FIG. 3 is a microscope photograph of particles of sodium size made by the method in this invention (magnification : 200*x*).

Thus, the particle size distribution of the co-precipitation compound is mainly governed by the particle size distribution of silicon dioxide, or the silicon dioxide and the glass powder of relatively large particle size. FIG. 3 shows that for agent A fine and uniform particles of sodium azide and obtained by the method of this invention. This becomes more clear when FIG. 3 is compared with FIG. 2 which shows commercially available sodium azide in normal use. The magnifications of FIG. 2 and FIG. 3 are the same, namely, 200*x*.

On combustion of the gas-generating agent, according to the invention, the azide is oxidized very fast with the oxidant, thus producing nitrogen gas and alkali metal oxide, which then reacts with the co-existing silicon dioxide to form alkali silicate.

The foregoing alkali silicate is further fused on the surfaces of the glass powder particles of larger size and the resulting substances are partially retained in the combustion chamber of the gas generator and are partially discharged in an easily capturable form, along with the generated gas.

Figure 4:
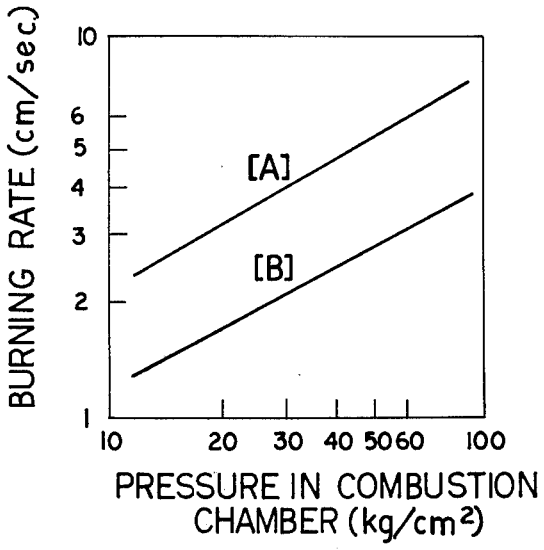
FIG. 4 is a graph showing the burning rate of the gas-generating agent (A) according to the invention and the prior art gas-generating agent (B).

The excellent combustibility of the gas-generating agent, according to the invention, compared to the prior art agent, is shown by the determination of the burning rates of the molded agents as indicated in FIG. 4. In this figure, straight line A indicates the burning rate of the gas-generating agent according to this invention, as described in the following Example 3, and straight line B shows that of the compound of sodium azide and potassium nitrate which is made by a conventional method. The latter compound is a product obtained by mixing 76 parts of powdery sodium azide and 24 parts of potassium nitrate and then compression molding the mixture. Comparing line A and line B, it can be seen that the burning rate of the gas-generating agent according to this invention is about two times that of the gas-generating agent made by the conventional method, under the same pressure in the combustion chamber.

Another advantage of this invention is that the addition of low-softening glass lowers the temperature of the generated gas. While the agent is burning, the gas generated and the residues produced thereby are at a high temperature and the solid components are in a fused state. the coexisting low-softening glass melts partially or wholly and absorbs the heat of the gas to lower its temperature to the extent that is harmless to the human body.

EMBODIMENTS OF THE INVENTION PREFERRED

This invention is further described by reference to the following illustrative, nonlimiting Examples. In the Examples all percentages are percent by weight.

EXAMPLE 1

Sodium azide (36.5 g) and 11.5 g of potassium nitrate were dissolved in 110 ml of hot water at 50° C and then 12 g of finely divided silicon dioxide (AEROSIL MOX 80, surface area 80 $m^2/g$, average particle size 30 m$\mu$, a product of N.Co.) was added with stirring into the solution so as to be blended uniformly therein. The resulting mixture (aqueous dispersion) was poured into a mixing vessel containing 600 ml of 99.5% ethanol cooled to 5° C. Fine powders of the co-precipitation compound of sodium azide and potassium nitrate, and silicon dioxide, were produced immediately and were filtered off. The yield of the precipitated solids was 70% (42 g). From analytical results, the solid was found to be composed of 49% of sodium azide, 6% of potassium nitrate, and 45% of silicon dioxide, and its particle size was from 4 to 12$\mu$.

After the compound was dried sufficiently, it was made into tablets of 5 mm in diameter and 3 mm in thickness. When 8 g of these tablets were burnt in a closed combustion bomb, a maximum generated gas pressure of 50 $kg/cm^2$ was observed in 100 milliseconds and a low softening glass was produced, but the formation of metallic sodium and sodium peroxide was not observed.

The test for the presence of metallic sodium was performed by adding water and testing for the evolution of hydrogen gas and the test for the presence of sodium peroxide was performed by adding potassium permanganate solution and observing the color change.

EXAMPLE 2

The co-precipitation compound was obtained by the same method as described in Example 1, except that silicon dioxide of 200 $m^2/g$ in surface area and 12 m$\mu$ in average particle size was used. From analytical results the precipitated solid was found to be composed of 50% of sodium azide, 7% of potassium nitrate and 43% of silicon diozide. The compound was from 3 to 12$\mu$ in particle size.

When the resulting tablets were burnt in the same manner as described in Example 1, a low softening glass was formed in the combustion bomb. Metallic sodium and sodium peroxide could not be detected.

EXAMPLE 3

A mixture of
Sodium azide — 27.4 g
Aerpgo; (MOX 80) — 4.0 g
Potassium nitrate — 8.6 g
Water (at 50° C) — 72 ml was treated by the same method as described in Example 1 to give a co-precipitation compound in 67% yield (26.8g). From analytical results, the compound was found to be composed of 66% of sodium azide, 19% of potassium nitrate, and 15% of silicon dioxide. The compound was from 3 to 12 microns in particle size.

When the resulting tablets were burnt in the same manner as described in Example 1, a maximum pressure of 120 $kg/cm^2$ was reached in 12 milliseconds. In the bomb, formation of low softening glass was observed but formation of metallic sodium and sodium peroxide was not observed.

COMPARATIVE EXAMPLES 1 – 3

Sodium azide, potassium nitrate and precipitated silicon dioxide of 1 to 20 $\mu$ in particle size were blended in a mortar and then were made into tablets. The tablets were burnt in the same manner as described in Example 1. The combustion results are indicated in Table 1.

TABLE 1

| RESULTS OF COMBUSTION | | Comparative Example 1 | Comparative Example 2 | Comparative Example 3 |
|---|---|---|---|---|
| sodium azide | (part) | 49 | 66 | 67 |
| potassium nitrate | (part) | 6 | 19 | 25 |
| silicon dioxide | (part) | 45 | 15 | 8 |
| tablet diameter | (mm) | 5 | 5 | 5 |
| tablet thickness | (mm) | 3 | 3 | 3 |
| amount used for combustion | (g) | 8 | 8 | 8 |
| maximum pressure in the combustion bomb | (kg/cm²) | very sowly reacted without combustion | 60 | 80 |
| time for internal pressure in the bomb to reach maximum (millisecond) | | — | 80 | 50 |
| presence of metallic sodium in the combustion bomb | | — | slightly present | slightly present |
| presence of sodium peroxide in the combustion bomb | | — | slightly present | present |

EXAMPLE 4

A mixture of
Sodium azide — 27.4 g
Aerosil (MOX 80) — 2.0 g
Potassium nitrate — 8.6 g
Water (at 50° C) — 72 ml was treated by the same method as in Example 1 to give a coprecipitation compound in 66% yield (25.08 g). From the analytical results, the compound was composed of 67% of sodium azide, 25% of potassium nitrate, and 8% of silicon dioxide. Its particle size was 4 to 12 microns.

When the resulting tablets were burnt, the maximum pressure reached 130 kg/g in 8 milliseconds. In the combustion bomb, formation of low softening glass was observed, but metallic sodium and sodium peroxide were not present.

EXAMPLE 5

Sodium azide (137 g) and 43 g of potassium nitrate were dissolved in 360 ml of hot water at 50° C. The solution was poured with stirring into a stirring vessel containing 99.5% ethanol cooled to 5° C and fine particles of the co-precipitation compound of sodium azide and potassium nitrate produced immediately were filtered off.

The yield of the compound was 66% (118.8 g). Analytical results of the compound showed that sodium azide and potassium nitrate were present in it in the ratio of 77 to 23 percent by weight. The particle size of the compound was 8 to 14$\mu$. After the compound was sufficiently dried, it was made into tablets of 5 mm in diameter and 3 mm in thickness. When 8 g of the tablets were burnt in a closed bomb of 120 ml volume, a maximum pressure of 165 kg/cm² was obtained in 11 milliseconds. Metallic sodium and sodium peroxide were not produced in the bomb.

EXAMPLE 6

One hundred and eighty two grams of sodium azide and 58 g of potassium nitrate were dissolved in 550 ml of hot water at 50° C. The solution was treated by the same method as described in Example 1 to obtain a co-precipitation compound of a particle size of 8 to 14$\mu$ in 60% yield (144 g). Sodium azide and potassium nitrate were present in the compound in the ratio of 89 to 11 percent by weight.

When the resulting tablets of the compound were burnt in the same manner as in Example 1, a maximum pressure of 150 kg/cm² was obtained in 120 milliseconds. In the bomb, production of sodium peroxide was not observed but metallic sodium was produced.

EXAMPLE 7

One hundred and seventeen grams of sodium azide and 63 g of potassium nitrate were dissolved in 360 ml of hot water at 50° C and then treated by the same method as in Example 1 to give a co-precipitation compound of a particle size of 4 to 8$\mu$ in 58% yield (104.4 g). Sodium azide and potassium nitrate were present in the compound in the ratio of 62 to 38 percent by weight.

When the resulting tablets were burnt in the same manner as in Example 1, a maximum pressure of 110 kg/cm² was obtained in 190 milliseconds. In the bomb, metallic sodium was not produced but production of sodium peroxide was observed.

COMPARATIVE EXAMPLES 4 – 6

Mixtures of sodium azide of a particle size of 35 to 55$\mu$ and potassium nitrate of a particle size of 20 to 100$\mu$ were pressed into tablets and burnt in the same manner as in Example 1. The results of the combustion tests are presented in Table 2.

TABLE 2

| RESULTS OF COMBUSTION | | | Comparative Example 4 | Comparative Example 5 | Comparative Example 6 |
|---|---|---|---|---|---|
| composition (part) | sodium azide | | 89 | 77 | 62 |
| | potassium nitrate | | 11 | 23 | 38 |
| particle size | ($\mu$) | | 20–100 | 20–100 | 20–100 |
| tablet | diameter | (mm) | 5 | 5 | 5 |
| | thickness | (mm) | 3 | 3 | 3 |
| amount used for combustion | | (g) | 8 | 8 | 8 |
| maximum pressure in the | | | 139 | 160 | 95 |

TABLE 2-continued

| RESULTS OF COMBUSTION | Comparative Example 4 | Comparative Example 5 | Comparative Example 6 |
|---|---|---|---|
| combustion bomb (kg/cm²) | | | |
| time for internal pressure in the bomb to reach the maximum (millisecond) | 145 | 60 | 220 |
| production of metallic sodium in the bomb | observed | observed | observed |
| production of sodium peroxide in the bomb | observed | observed | observed |

EXAMPLE 8

One hundred thirty seven grams of sodium azide and 43 g of potassium nitrate were dissolved in 360 ml of hot water at 50° C. The solution was poured with stirring into a vessel provided with an agitator and containing 6000 ml of ethanol. The fine powder of co-precipitation compound of sodium azide and potassium nitrate thereby produced was filtered off. Analytical results indicated that the compound was composed of 77% of sodium azide, and 23% of potassium nitrate. The yield of the compound was 66%.

The compound was made into tablets of 5 mm in diameter and 3 mm in thickness. Forty grams of the tablets were subjected to a combustion test in a combustion bomb. The combustion bomb had an internal volume of 60 ml and contained a filter composed of 10 sheets of 20 mesh wire net, 10 sheets of 100 mesh wire net, and 10 sheets of 300 mesh wire net, arranged in a stack wherein the respective types of sheets were alternately arranged, and through which the generated gas was passed. All of the foregoing wire nets were of disc form of 75 mm diameter.

When 40 grams of the tablets were burnt, the maximum pressure in the combustion bomb reached 165 kg/cm² in about 11 milliseconds.

Most of the fine powders produced passed through the filter along with the generated gas.

EXAMPLE 9

A co-precipitation compound was prepared by the same method as described in the following Example 10, except that 32 g of glass powder having an average particle size of 74$\mu$ was added to the composition in Example 8. Analytical results showed that the finely divided particles of co-precipitation compound thus obtained were composed of 52% of sodium azide, 16% of potassium nitrate, 26% of silicon dioxide, and 6% of glass powder.

The resulting composition was made into tablets in the same manner as described in Example 8. When 40 grams of the tablets were burnt in the same manner as described in Example 8, the pressure in the combustion chamber reached a maximum value of 125 kg/cm² in about 12 milliseconds.

The results of this test indicated that the fine powder produced along with the generated gas was changed into a glassy form and was captured by the filter of wire net layers as described in Example 8.

EXAMPLE 10

Four hundred and thirteen grams of sodium azide and 130 g of potassium nitrate were dissolved in 900 ml of hot water at 50° C. Into the solution was added 124 g of silicon dioxide (Tradename: Aerosil MOX 80) and then was treated by the same method as described in Example 8 to give finely divided particles of a co-precipitation compound. Analytical results showed that the compound was composed of 53% of sodium azide, 15% of potassium nitrate, and 32% of silicon dioxide. The yield of the compound was 69%.

The resulting composition was made into tablets in the same manner as in Example 8. When 40 g of the tablets were burnt, the inner pressure in the combustion chamber reached a maximum value of 130 kg/cm² in about 12 milliseconds.

The results of the test indicated that all of the fine powders produced along with the generated gas had changed into glass but small amounts of fine powdery glass had passed through the filter of wire nets.

The embodiments of the invention in which an exclusive property or privilege is claimed are defined as follows:

1. A gas generating agent consisting essentially of finely divided particles of a co-precipitation product obtained by the steps of 1. preparing a uniform aqueous solution consisting essentially of (a) an azide component consisting of one or a mixture of two or more azides selected from the group consisting of alkali metal azides and alkaline earth metal azides, and (b) an oxidant component consisting of one or a mixture of two or more oxidants selected from the group consisting of alkali metal nitrates, alkali metal perchlorates, alkaline earth metal nitrates and alkaline earth metal perchlorates;
2. adding said aqeous solution to water-soluble organic solvent and thereby precipitating a co-precipitation product of (a) and (b) wherein the weight ratio of a/b is in the range of from 95/5 to 50/50;
3. separating and drying the co-precipitation product.

2. A gas-generating agent as set forth in claim 1 wherein the water-soluble organic solvent is selected from the group consisting of methanol, ethanol, acetone, and iso-propanol.

3. A gas generating agent consisting essentially of finely divided particles of a co-precipitation product obtained by the steps of 1. preparing a uniform aqueous dispersion consisting essentially of an aqeuous solution of (a) an azide component consisting of one or a mixture of two or more azides selected from the group consisting of alkali metal azides and alkaline earth metal azides, and (b) an oxidant component consisting of one or a mixture of two or more oxidants selected from the group consisting of alkali metal nitrates, alkali metal perchlorates, alkaline earth metal nitrates and alkaline earth metal perchlorates, said solution having dispersed therein (c) particles of silicon dioxide selected from the group consisting of (i) a flocculate having an overall flocculate size of 2 to 150 microns and a surface area of 50 to 450 $m^2/g$ and consisting of spherical silicon dioxide powder having a particle size of 1 to 100 millimicrons, and (ii) colloidal silica having a particle size of 1 to 100 millimicrons and a surface area of from 22 to 120 $m^2/g$;

2. adding said aqueous dispersion to water-soluble organic solvent and thereby precipitating a co-precipitation product of (*a*), (*b*) and (*c*), wherein the weight ratio of *a*/*b* is in the range of from 95/5 to 50/50 and the weight ratio of *a* plus *b*/*c* is from 97/3 to 55/45;

3. separating and drying the co-precipitation product.

4. A gas-generating agent as set forth in claim 3 wherein the water-soluble organic solvent is selected from the group consisting of methanol, ethanol, acetone, and iso-propanol.

5. A gas generating agent consisting essentially of finely divided particles of a co-precipitation product obtained by the steps of 1. preparing a uniform aqueous dispersion consisting essentially of an aqueous solution of (a) an azide component consisting of one or a mixture of two or more azides selected from the group consisting of alkali metal azides and alkaline earth metal azides, and (b) an oxidant component consisting of one or a mixture of two or more oxidants selected from the group consisting of alkali metal nitrates, alkali metal perchlorates, alkaline earth metal nitrates and alkaline earth metal perchlorates, said solution having dispersed therein (c) particles of silicon dioxide selected from the group consisting of (i) a flocculate having an overall flocculate size of 2 to 150 microns and a surface area of 50 to 450 $m^2/g$ and consisting of spherical silicon dioxide powder having a particle size of 1 to 100 millimicrons, and (ii) colloidal silica having a particle size of 1 to 100 millimicrons and a surface area of from 22 to 120 $m^2/g$, and (d) particles of glass having a low softening temperature and having a particle size of from 5 to 300 microns;

2. adding said aqueous dispersion to water-soluble organic solvent and thereby precipitating a co-precipitation product of (*a*), (*b*), (*c*) and (*d*) wherein the weight ratio of *a*/*b* is in the range of from 95/5 to 50/50, the weight ratio of *a* plus *b*/*c* is from 97/3 to 55/45, and containing from 3 to 50 weight percent of (*d*), based on the total weight of the co-precipitation, product;

3. separating and drying the co-precipitation product.

6. A gas-generating agent as set forth in claim 5 wherein the glass is a low softening glass essentially consisting of 5 to 75% by weight of $SiO_2$, 0 to 50% by weight of CaO, 1 to 40% by weight of $Al_2O_3$, 0 to 25% by weight of $B_2O_3$, 0 to 20% by weight of $K_2O$, 0 to 20% by weight of $Na_2O$, 0 to 15% by weight of MgO, and 0 to 60% by weight of PbO.

7. A gas-generating agent as set forth in claim 5 wherein the water-soluble organic solvent is selected from the group consisting of methanol, ethanol, acetone, and iso-propanol.

* * * * *

UNITED STATES PATENT AND TRADEMARK OFFICE

CERTIFICATE OF CORRECTION

PATENT NO. : 4 021 275

DATED : May 3, 1977

INVENTOR(S) : Kazuo Kishi and Kazuo Naganuma

It is certified that error appears in the above-identified patent and that said Letters Patent are hereby corrected as shown below:

In the Foreign Application Priority Data; please change "Apr. 30, 1974" to ---Apr. 30, 1975---.

Column 10, line 45; change "aqeous" to ---aqueous---.

Signed and Sealed this thirtieth Day of August 1977

[SEAL]

*Attest:*

RUTH C. MASON
*Attesting Officer*

C. MARSHALL DANN
*Commissioner of Patents and Trademarks*